US006424246B1

(12) United States Patent
Kysely et al.

(10) Patent No.: US 6,424,246 B1
(45) Date of Patent: Jul. 23, 2002

(54) TRANSFORMER CORE AND COIL SUPPORT

(75) Inventors: Joseph H. Kysely, Palmyra; Richard M. Marusinec, Delafield; Jonathan Schaar, Waukesha, all of WI (US)

(73) Assignee: McGraw-Edison Company, Houston, TX (US)

( * ) Notice: Subject to any disclaimer, the term of this patent is extended or adjusted under 35 U.S.C. 154(b) by 0 days.

(21) Appl. No.: 09/452,948

(22) Filed: Dec. 2, 1999

(51) Int. Cl.[7] ..... H01F 27/02

(52) U.S. Cl. ..... 336/90; 336/92; 336/196; 336/210

(58) Field of Search ..... 336/210, 65, 196, 336/66–67, 90, 92

(56) References Cited

U.S. PATENT DOCUMENTS 4,833,436 A * 5/1989 Martin et al. ..... 336/60
4,837,543 A * 6/1989 Humen et al. ..... 336/92
4,890,086 A * 12/1989 Hill ..... 336/210
5,194,841 A * 3/1993 Galloway et al. ..... 336/92
5,319,341 A * 6/1994 Bisbee et al. ..... 336/67
5,684,446 A * 11/1997 Adkins et al. ..... 336/92

* cited by examiner

*Primary Examiner*—Lincoln Donovan
*Assistant Examiner*—Tuyen Nguyen

(74) *Attorney, Agent, or Firm*—Fish & Richardson P.C.

(57) ABSTRACT

A transformer includes a tank having a side wall, a core defining a core window, and a pair of coils, each of which surrounds a portion of the core and includes a portion passing through the core window. The transformer further includes a core and coil support member that extends through the core window to support the core and coils. The core and coil support member includes an upper flange and a lower flange, each flange having a channel formed along an outer surface of the flange that conforms in shape to an inner surface of the core. The core and coil support member includes a web that extends between and connects the upper and lower flanges, the web including first and second ends that extend out from the flanges. The transformer includes a support bracket that attaches to the side wall of the tank, and centers and supports the core and coil support member. The support bracket includes three sides that define a channel through which an end of the core and coil member extends. The support bracket also includes a shelf formed from a lower end of a side panel, the shelf being substantially perpendicular to the first direction to support the weight of the core and coil support member when inserted into the channel. The support bracket also includes a tab formed from an upper end of a side panel. The tab is bent inwardly after the core and coil support member is inserted into the channel to provide a lock position to the core and coil support member in the first direction.

35 Claims, 5 Drawing Sheets

TRANSFORMER CORE AND COIL SUPPORT

TECHNICAL FIELD

This application relates to supporting structure for the core and coil assembly of a transformer.

BACKGROUND

Single phase transformers typically include a pair of windings that are magnetically coupled through a permeable core, or a single coil coupled with two cores. The core and coil assembly is positioned in a tank that is filled with a dielectric fluid. The fluid serves the dual purpose of cooling the assembly and electrically insulating the coils from one another and from the grounded core and tank wall. The insulating fluid also impregnates the Kraft paper utilized as solid insulation within the windings and core and coil assembly. A structure for supporting a core and coil assembly is described in U.S. Pat. No. 4,837,543, which is incorporated by reference.

SUMMARY

In accordance with one general aspect of the invention, a transformer includes a tank having a side wall, a core defining a core window, a pair of coils, and a core and coil support member that extends through the core window to support the core and coils. Each coil surrounds a portion of the core and includes a portion passing through the core window.

The core and coil support member includes an upper flange and a lower flange, each flange having a channel formed along an outer surface of the flange that conforms in shape to an inner surface of the core. The core and coil support member also includes a web extending between and connecting the upper and lower flanges. Substantially beyond the flanges, first and second ends are formed from extensions of the web. A support bracket that attaches to the side wall of the tank and supports the core and coil support member, includes three sides that define a channel through which an end of the core and coil member extends.

Embodiments may include one or more of the following features. For example, the core may include first and second vertical portions, the second vertical portion being substantially similar in shape and size to the first vertical portion. The core may include first and second horizontal portions each extending between ends of the first vertical portion and the second vertical portion. The vertical and horizontal portions define the core window.

The core and coil support member may be molded using a reinforced high temperature engineering polymer.

The upper flange may extend perpendicularly from an upper side of the web. Likewise, the lower flange may extend perpendicularly from a lower side of the web. The flanges may be convex in shape. An upper horizontal portion of the core may rest on the upper flange. The coils may rest on the lower flange, and will generally fit between the upper and lower flanges. The coils may also act as a mechanical strut to support the weight of the core on the upper flange.

The channel may include a lowered step. A width of the channel may be substantially equal to a width of a portion of the core facing the core window. The channel may be convex. The channel may serve to lock the core into a stationary position. Moreover, the channel may serve to center the core onto the core and coil support member.

The web may separate and insulate the coils from each other. Furthermore, the web may include a first vertical face that extends perpendicularly from the first end, and a second vertical face that extends perpendicularly from the second end. The vertical face may define an end groove in which the support bracket is secured during assembly and shipping of the transformer. The vertical faces may increase strength of the core and coil support member.

The tank may include dielectric fluid. The web may include a thermal duct design along a side of the web that faces the supported coil. The thermal duct design includes grooves that provide a flow path for the dielectric fluid between the supported coil and the web.

The upper and lower flanges may include a snap-fit connector that permits assembly of brackets for components to the core and coil support member.

In accordance with another general aspect of the invention, a transformer includes a tank having a side wall, a core defining a core window, and a pair of coils. Each of the coils surrounds a portion of the core and includes a portion passing through the core window. The transformer also includes a core and coil support member that extends through the core window to support the core and coils, and a first support bracket that attaches to the side wall of the tank, and supports the core and coil support member. The first support bracket includes two parallel side panels, and a rear panel that connects the parallel side panels to define a channel in a first direction through which the core and coil support member is inserted and positioned. The first support bracket also includes a shelf formed from a lower end of a side panel. The shelf is substantially perpendicular to the first direction. A locking feature is formed from an upper end of a side panel. The locking feature provides a retaining force to the core and coil support member in the first direction.

Embodiments may include one or more of the following features. For example, the first support bracket may include a shelf slot that is formed into a lower end of the side panel across the channel from the side panel that forms the shelf. The shelf slot is made large enough to accommodate and support the perpendicular shelf.

The locking feature may include side apertures through which self-tapping screws are inserted to secure the core and coil support member within the channel of the first support bracket. The locking feature also may include a tab that is bent inwardly after the core and coil support member is inserted into the channel to secure the core and coil support member within the channel of the first support bracket.

The shelf may support at least a portion of the weight of the core and coil support member when inserted into the channel. Alternatively or in addition, the tank or tank bottom may support at least a portion of the weight of the core and coil support member when inserted into the channel.

The core and coil support member may include a first end and a second end that extends from the first end in a direction perpendicular to the first direction. The rear panel may include a spring lever that applies a force to the core and coil support member in the perpendicular direction.

The transformer may further include a second support bracket identical in size and shape to the first support bracket, and attached to an opposite side wall of the tank. The first end of the core and coil support member may be inserted and positioned in the channel of the first support bracket. The second end of the core and coil support member is inserted and positioned in the channel of the second support bracket. The rear spring levers of the support brackets may automatically center the core and coil support member in the perpendicular direction.

The first support bracket may include a projection bent from on a top portion of a parallel side panel in a direction away from the channel. The angle may be based on a size of the coils relative to a size of the tank. Alternatively, the angle may be based on a length of the top portion of the parallel side panel. The projection may also facilitate guidance of the core and coil support member through the channel. Additionally, one or more components may be secured to the projection. The bend angle of the projection may be based on the components secured to the projection.

The core and coil support member serves a number of additional functions. For example, the core and coil support member can be used to anchor and support high voltage leads extending from the coils. The core and coil support member also prevents the corners of the core from cutting a core tube that is inserted into the coil windows. The core tube provides insulation between the core and the coil. The support member also eliminates the need for coil blocks, which had been used to position and clamp the core and coils between upper and lower steel core clamps. This, in turn, eliminates problems associated with the coil blocks compressing the paper at the ends of the coil, which could lead to reduced coil end margins and a higher probability of electrical shorts.

Since the core is in tension in the transformer, that is, there is no compressive stress on the core steel, no-load core losses are reduced. Moreover, elimination of top and bottom steel core clamps and associated metal brackets of prior designs reduces stray losses.

On smaller transformer designs, the core and coil support member can suspend the entire weight of the core and coils. On larger transformer designs, a strut member may be added to each side of the core and coil support member to help support the weight of the core. It is also possible to support the weight of the core by using, for example, a cradle member on the tank bottom.

Tolerances and clearances between the tank wall and the coils can be reduced because the core and coil support member centers the core and coil better in the tank than prior core clamp assemblies. Thus, some transformer designs will accommodate a smaller tank size.

Manufacturing costs are reduced because of the improved manufacturing efficiency. In particular, the core steel is easier to stack because the core and coil support member minimizes the relative movement of the coils with respect to one another. The extra time required to attach the existing steel clamps and insulation pieces is also eliminated. Additionally, the core and coils are easier to install in the tank, and hardware is eliminated by using snap fit connectors. Furthermore, for some implementations, part count proliferation may be reduced from approximately 25 parts to five parts.

The core and coil support member may be clamped in a stacking fixture to keep the coils from shifting during stacking. Furthermore, because the core and coil support member replaces many parts that were previously made of metal, an additional reduction in cost is realized. Finally, because core and coil assembly heights may be reduced in the transformer design, the tank size and amount of dielectric fluid may be reduced, thus further reducing the cost of the transformer.

The design also improves cooling of the coils because there is less obstruction to convective fluid flow around and through the coils. Cooling ducts added to the core and coil support member web further increase cooling efficiency to the coil within the core window. Because the core and coil support member can be made of a high temperature engineering polymer, the core and coil support member can be operated at higher temperatures than current Kraft-based materials without compromising the electrical and mechanical integrity of the design. The engineering polymers also exhibit better long-term aging characteristics than previously used cellulose-based materials. The high temperature engineering polymer provides the structural rigidity necessary to support the core and coils and has high dielectric strength.

DETAILED DESCRIPTION

Figure 1:
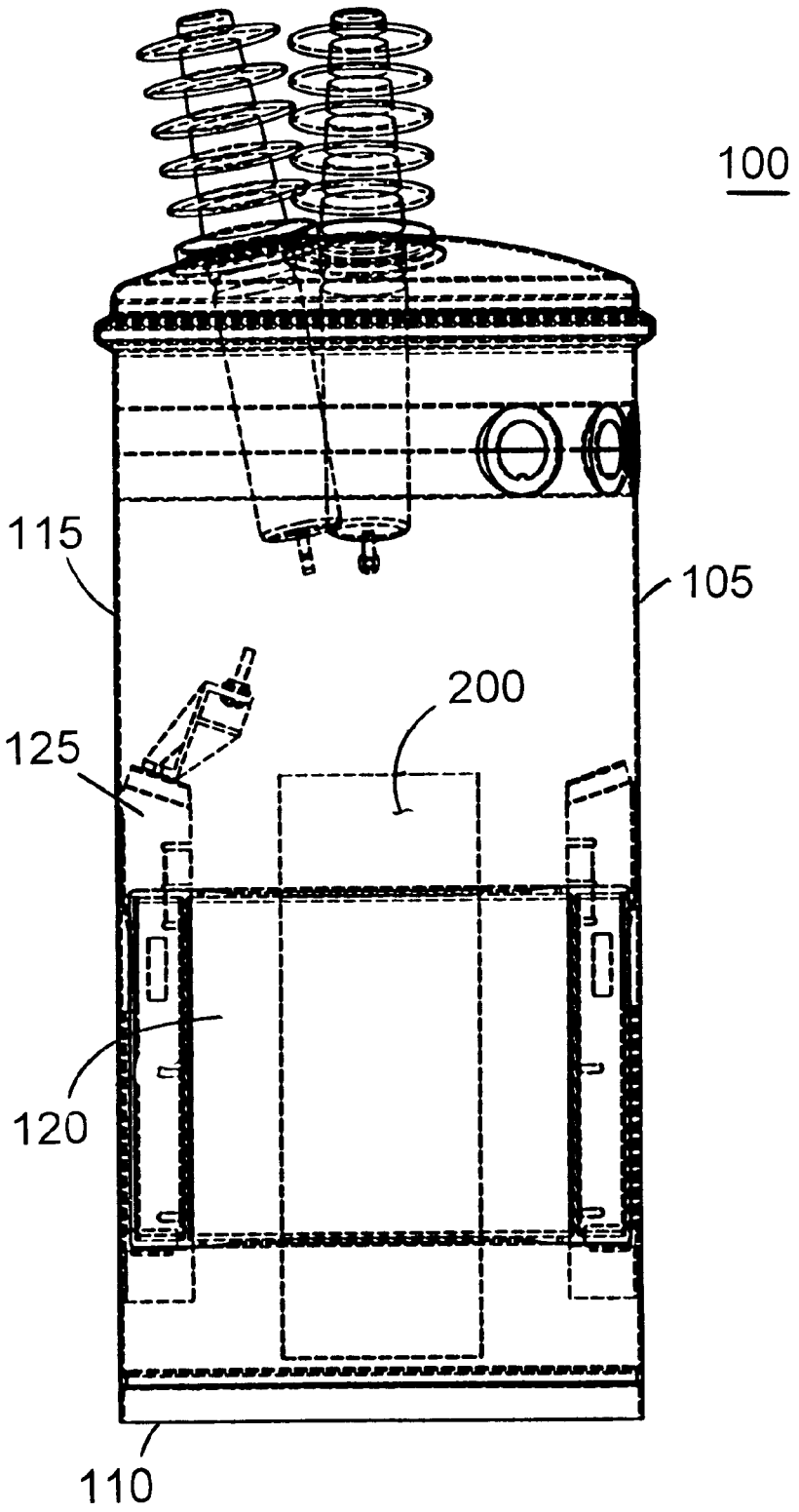
FIG. 1 is a side view of a transformer tank using broken lines to show a core and coil assembly and other elements contained in the tank.

Referring to FIG. 1, a transformer 100 includes a cylindrical tank 105 having a bottom 110 and a side wall 115. The tank 105 contains a core and coil assembly 120 that is supported within the tank 105 by a set of support brackets 125. The brackets 125 are welded to the side wall 115 by, for example, spot welding or projection welding. The brackets 125 may be fabricated of any suitable durable material that may be formed and punched, such as, for example, sheet metal. Because the core and coil assembly 120 reaches extreme temperatures during operation, the tank 105 is filled with a dielectric fluid that cools the core and coil assembly 120.

Figure 2:
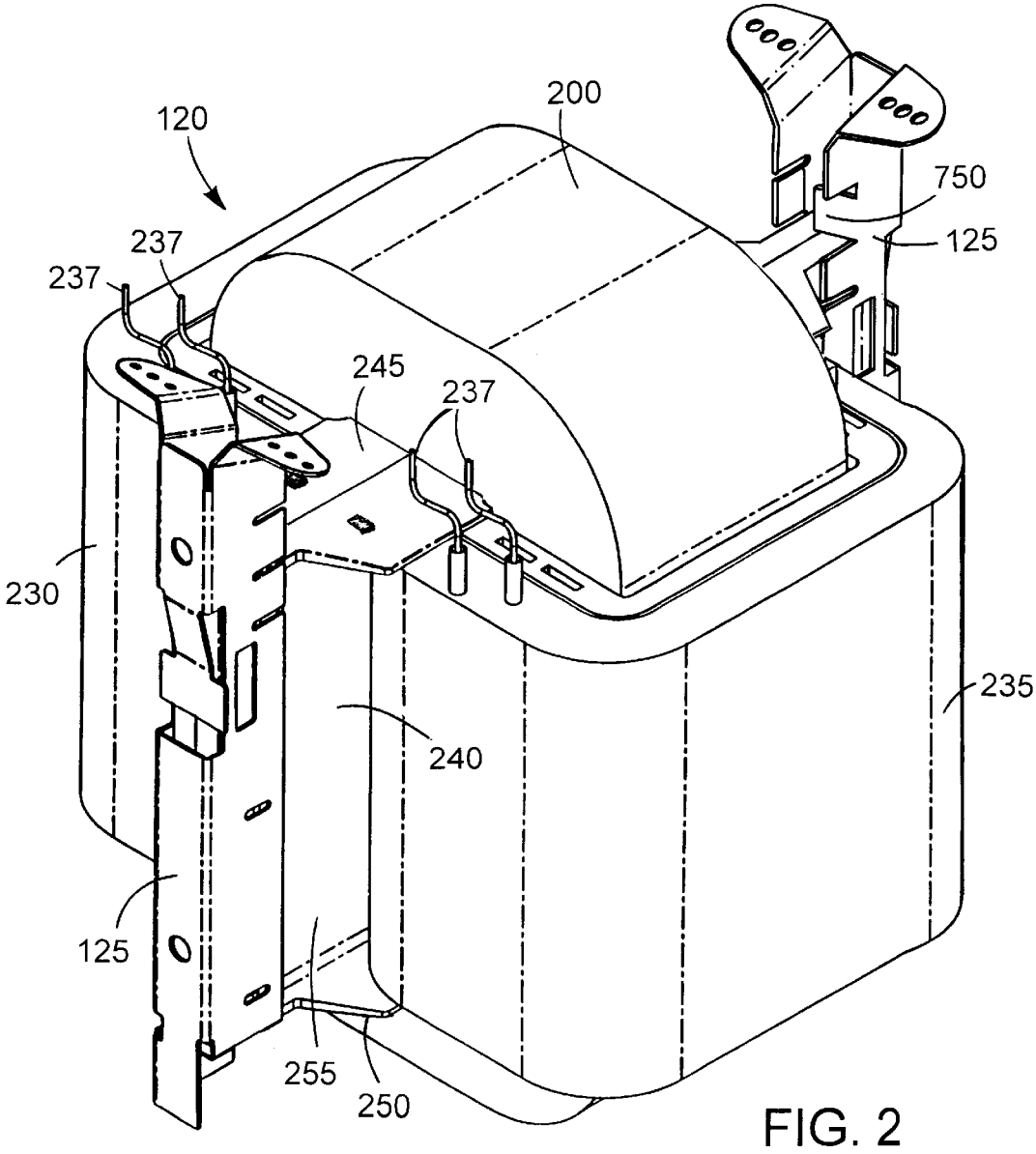
FIG. 2 is a perspective view of a core and coil assembly and support brackets of the transformer of FIG. 1.
Figure 3:
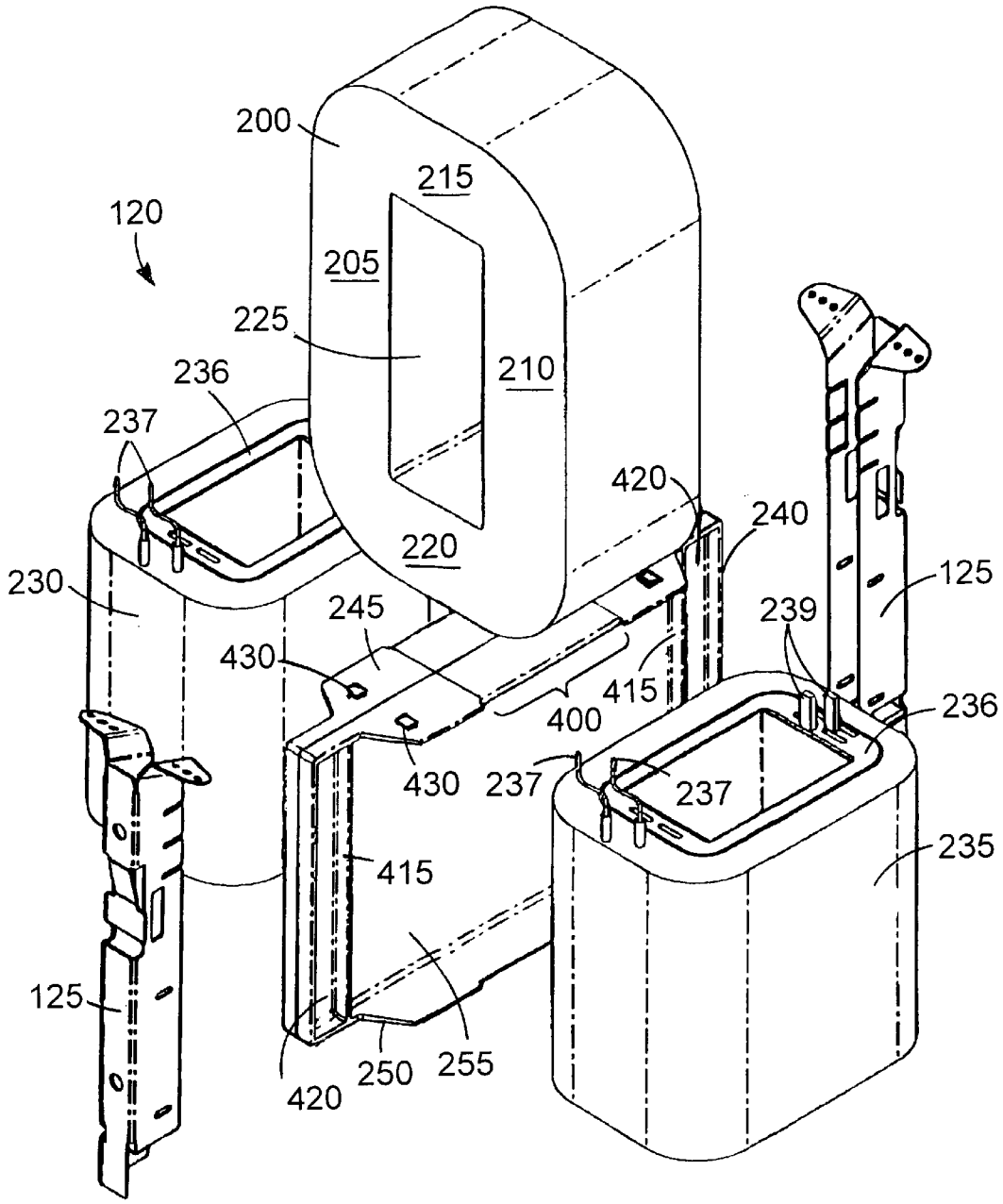
FIG. 3 is a perspective exploded view showing components of the core and coil assembly and support brackets of FIG. 2.

Referring also to FIGS. 2 and 3 the core and coil assembly 120 includes a core 200 that includes vertical portions 205 and 210, and horizontal portions 215 and 220 extending between the vertical portions to define a core window 225. The core is made of a material that has a high magnetic permeability, such as iron, and is typically laminated with sheets of iron.

The core and coil assembly 120 also includes first and second coils 230 and 235 that surround, respectively, the first and second vertical portions 205 and 210 of the core 200. The coils 230 and 235 surround the portions 205 and 210 of the magnetic core 200 to magnetically couple the coils.

For assembly, the bottom portion 220 of the laminated core may be split in half, and the top portion 215 may be flexed, so as to pass one of the vertical portions and half of the bottom portion 220 through a core tube 236 that has been inserted into each coil to protect and separate the coil from direct contact with the core. Once the coils are in place, the bottom laminations are interleaved to form the core and complete the magnetic circuit.

Each of the coils 230, 235 is made from, respectively, conductive wires 237, 239. Connection to the wires is made through high voltage electrical connectors.

The core and coil assembly 120 also includes a support member 240, which may be in the shape of an I-beam. The I-beam 240 carries the weight of the core and coils and holds them in place within the tank and relative to each other. The I-beam 240 is made of a structural insulating material, such as a reinforced high temperature engineering polymer. The I-beam 240 includes a horizontal upper flange 245, a horizontal lower flange 250, and a vertical web 255 extending between and connecting the flanges 245 and 250.

Figure 4:
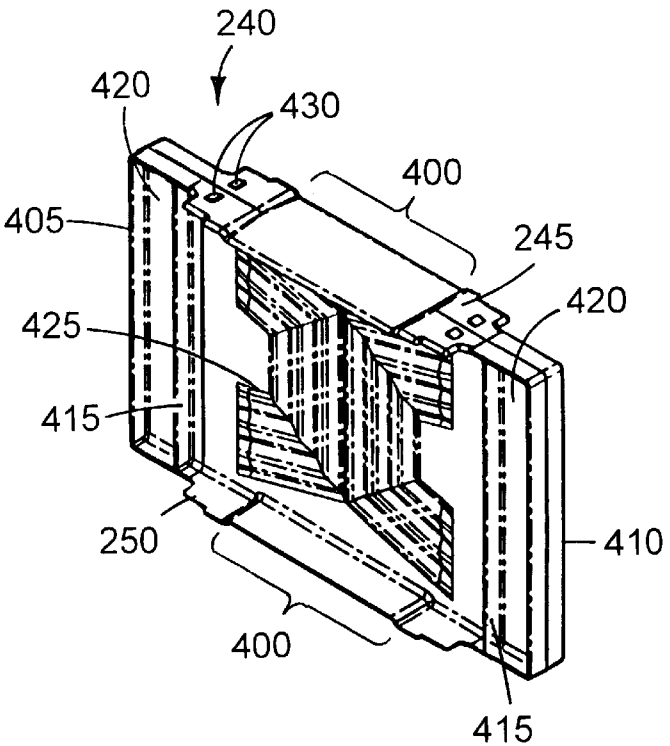
FIG. 4 is a perspective view of a support member of the core and coil assembly of FIG. 2.
Figure 6:
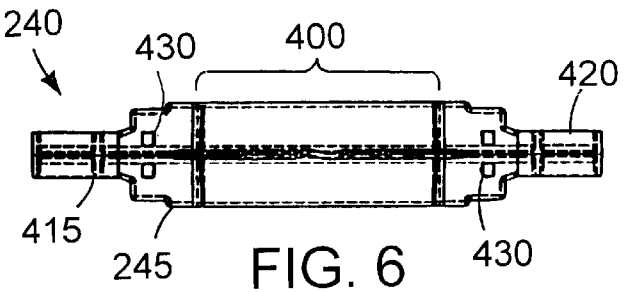
FIGS. 5 and 6 are, respectively, side and top views of the support member of FIG. 4.
Figure 5:
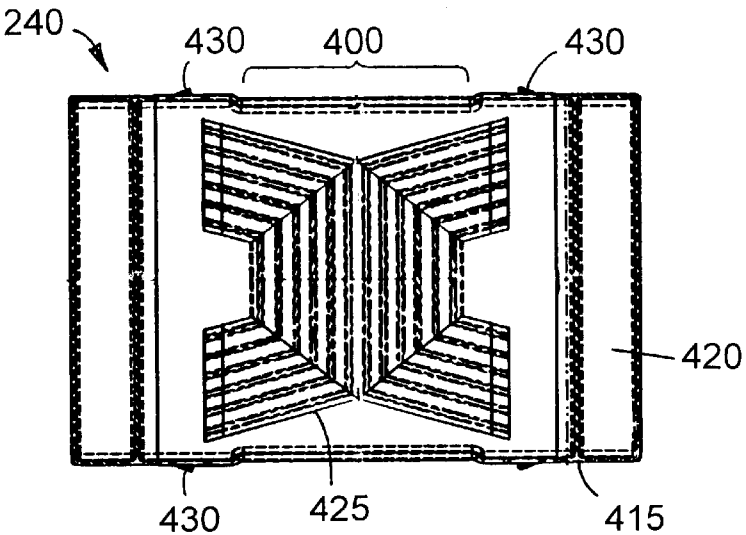

Referring also to FIGS. 4–6, a lowered step or channel 400 may be formed along outside surfaces of the upper and lower flanges 245 and 250. The channel 400 has a width substantially equal to an inside (that is, facing the core window) width of the core 200 and is shaped to mate with the inside faces of the horizontal portions 215, 220. For example, if the inside face of the horizontal portion 215 or 220 is concave, which is typically the case due to the core forming process, then the channel 400 has a convex shape. Likewise, the upper and lower flanges 245, 250 may have a convex shape. Such a flange design might be easier to manufacture if the channel is to be made convex. Moreover, a convex flange design would exhibit additional rigidity and strength relative to a flat flange design.

The channel 400 performs several functions that add to the sophistication of the I-beam design. First, the channel 400 increases strength to the flange 245 and 250 by providing an additional structure. Second, because the core 200 rests within the channel when assembled with the I-beam 240, the channel 400 serves to lock the core 200 in place. And third, during assembly, the channel 400 provides a mechanism for quickly centering the core 200 relative to the I-beam.

Referring again to FIGS. 2 and 3, during assembly, once the coils 230 and 235 are positioned on the I-beam 240, the core is inserted through the coils such that the I-beam vertical web 255 and the inner windings of the first and second coils 230 and 235 extend through the core window 225. The inside surfaces of the horizontal portions 215 and 220 rest within the respective channels 400 to lock the core into a snug position. Furthermore, since the coils are nested between the I-beam flanges 245, 250, the coils are also locked into position.

More particularly, the upper horizontal portion 215 of the core 200 rests on the channel 400 of the upper flange 245 of the I-beam 240. The coils 230, 235 fit between the upper flange 245 and the lower flange 250. Thus, the I-beam 240 supports the coils independently of the core. Alternatively stated, the weight of the coils is transferred directly to the lower flange of the I-beam, and is not transferred to the I-beam through the core. Moreover, although the coils extend through the core window, the web 255 separates and insulates the coils from each other.

Referring again to FIGS. 4–6, the vertical web 255 of the I-beam 240 extends beyond the flanges 245, 250 to form first and second ends 405 and 410. A vertical face 415 may be formed in the ends 405, 410 to extend perpendicularly outward from the web 255. The face 415 and an end 405 or 410 define a vertical groove 420 that may be used during assembly and shipping to secure the I-beam 240 to the bracket 125. Moreover, the faces 415 and grooves 420 along the ends add rigidity and strength to the I-beam 240.

The I-beam 240 may include a thermal duct design 425 along both faces of the vertical web 255. The thermal duct design 425 includes grooves formed in the face, with the grooves being arranged in a pattern for providing a flow path for dielectric fluid between the I-beam and the adjacent coil side. For example, the pattern shown in FIG. 4 is designed to allow fluid to flow in an upward direction with significant access to the majority of the coil surface. The duct design pattern is typically asymmetrical from one side of the web 255 to the other. In this way, uniform wall thickness is maintained throughout the web 255 to increase I-beam molding efficiency.

The I-beam 240 also includes snap-fit connectors or dimples 430 on both the upper and lower flanges 245, 250. The snap-fit connectors 430 permit assembly of brackets for components and lead guides to the I-beam. The snap-fit connectors 430 may be used to attach a strut member on heavier transformer units to help support the core and coil assembly 120. Because their modulus of elasticity lies in a preferable range, plastics are ideally suited for the snap-fit connector 430. The snap-fit connectors 430 permit a reduction in assembly and mounting time by eliminating need for separate mounting hardware. The connectors 430 may be formed in the shape and size appropriate for the attachments to be connected to the I-beam.

Figure 7:
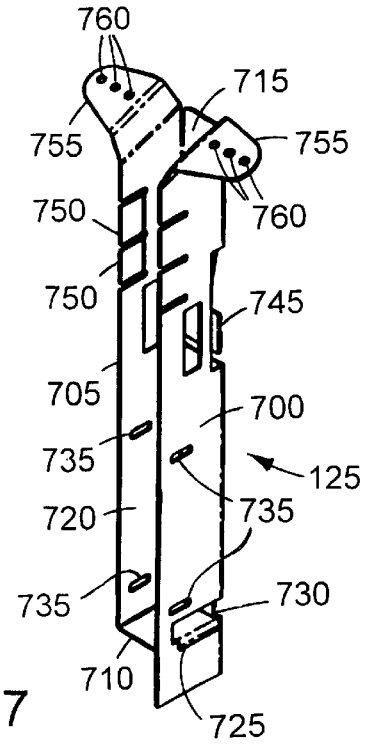
FIG. 7 is a perspective view of the bracket that supports and attaches the support member to the tank.
Figure 8:
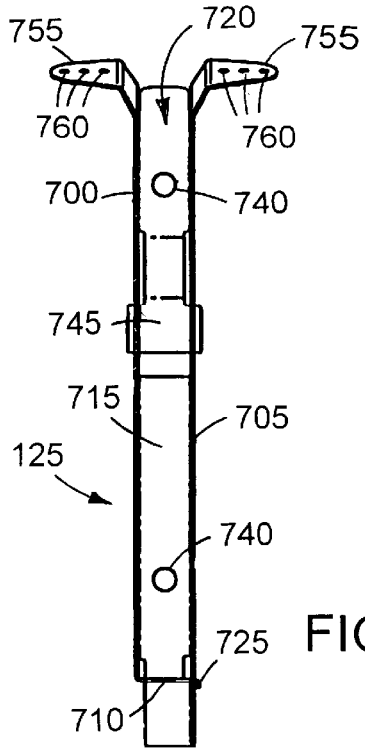
FIG. 8 is a front view of the support bracket of FIG. 7.
Figure 9:
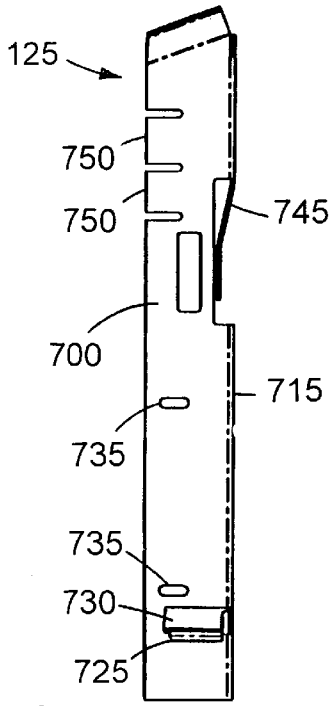
FIGS. 9 and 10 are side views of the support bracket of FIG. 7.

Referring to FIGS. 7–9, the support bracket 125 includes side panels 700, 705, a shelf 710, and a rear panel 715 that together form an I-beam channel 720 through which the end 405 or 410 extends. When the I-beam is in position, the end 405, 410 rests atop the shelf 710 of its respective support bracket 125. The shelf 710 is formed directly from a lower part of one of the side panels (side panel 705 in FIGS. 7–9) by forming a 90° bend in the lower part of the side panel. A tab 725 formed on the end of the shelf extends through and rests atop a shelf slot 730 that is formed or punched on the other side panel (side panel 700 in FIGS. 7–9). Using this design, no additional welding or fastening operation is required to attach a shelf member because the shelf is integral to a side panel of the bracket 125. The lower part of the other side panel may be used to rest the bracket 125 on the bottom 110 of the tank.

The support bracket 125 also includes side panel slots or holes 735 that are used to weld the bracket to the tank wall by facilitating positioning of the bracket in the transformer tank. A set of rear panel holes 740 are formed in the bracket 125 to facilitate manufacturing of the bracket 125, and therefore, are not integral to the assembled transformer structure. The rear panel holes 740 are used to locate the bracket in each station of a progressive die.

The support bracket 125 includes a spring lever 745 along the rear panel 715. The spring lever 745 is punched from the rear panel 715 and then bent into an appropriate biasing shape. The spring lever 745 applies a force to the I-beam in the horizontal direction and therefore acts as a self-centering mechanism for the I-beam. Furthermore, the spring lever 745 accounts for different manufacturing tolerances in the fabrication of the I-beam, bracket, and assembly. For example, if the tank diameter is slightly smaller than its usual diameter, then the I-beam can still be mounted within the brackets because enough tension is provided by the spring lever 745 to properly center the I-beam. Likewise, a larger tank diameter can also be accommodated because the spring levers will still center the core and coil assembly.

One or more locking features such as side tabs 750 may be formed or punched into the side panels 700, 705. The side tabs 750 are flush with the side panels 700, 705 during insertion of the I-beam 240 into the brackets 125 to permit the I-beam ends 405, 410 to freely move through the I-beam bracket channels 720. After the I-beam is inserted within the brackets 125, the side tab 750 may be bent inward through an appropriate angle to secure the I-beam in the vertical direction. The side tabs 750 may be positioned in the vertical direction along the side panel 700, 705 depending on the vertical height of the I-beam. For example, if a typical I-beam has a height of eight inches, then the bottom of the tab to be bent is approximately eight inches from the top of the shelf 710. The distance between the shelf 710 and the bent tab is large enough to fit the I-beam yet small enough to prevent the I-beam from moving in the vertical direction. One of the tabs in the bracket 125 of FIG. 2 is bent inward to show its use with the I-beam. Any number of tabs 750 may be formed into the side panel of the bracket depending on the size of the I-beam to be secured by the tabs.

Figure 10:
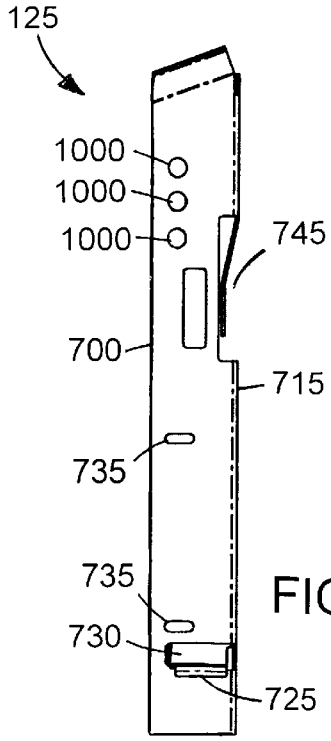

Referring also to FIG. 10, the locking features may be slots or holes 1000 through which self-tapping screws are inserted to mount and secure the I-beam between the brackets. The self-tapping screws clamp the I-beam into position much like the tabs 750 to prevent movement of the I-beam in the vertical direction during shipping and installation. Because self-tapping screws would be used, additional parts, such as nuts, bolts, or clamps, are eliminated from the design. Any number of slots or holes 1000 may be designed into the side of the bracket depending on the size of the I-beam that is supported by the bracket.

In addition to holding the core and coil assembly 120 in place, the support bracket 125 serves as a guide for lowering the core and coil assembly 120 into the tank 105. To this end, projections or wings 755 may be formed on the tops of the side panels 700, 705. The wings 755 serve to facilitate guidance of the I-beam down through the channel 720 during assembly by providing a point of reference relative to the side panels 700, 705 which may be difficult to visualize within the tank 105. The wings 755 are bent outward from the channel 720 by any suitable angle, for example 75°. Additionally, the wings 755 provide surfaces on which additional components can be mounted. To facilitate mounting components, holes 760 may be punched or extruded into the wings 755. Alternatively, or additionally, components may be secured to the wings 755 by any other suitable technique, such as, for example, by snapping to the wing 755. If the wing 755 is used to mount components, then the bend angle of the wing may depend on the type of component mounted onto the wing. Moreover, the bend angle and length of projection of the wing 755 may be chosen to maintain sufficient electrical clearance between the high voltage terminals of the coils and the tank wall 115.

In previous transformer structures, sheet metal core clamps with complicated brackets that bolted to the tank wall with L-brackets were used. One such prior transformer structure included 25 separate parts. With the transformer design of FIG. 1, manufacturing and assembly costs are reduced because there are fewer parts and assembly of the parts is much simpler.

Because of the new I-beam and bracket design, the transformer can be used for different applications with various sized coils. For example, the support bracket 125 is adaptable to differently sized I-beams. Also, the spring levers 745 provide for I-beams of a single width to fit in multiple tank diameters. The side tabs provide for I-beams of various heights. Moreover, the width of the rear panel 715 may be universal for all I-beams. The I-beam flange width may be adjusted depending on the size of the core and the design of the transformer. The projection from the top of the bracket also facilitates greater flexibility in the number of components that can be added to the transformer design.

The I-beam 240 transfers a portion of the weight of the core and coils from the bottom 110 of the tank to the side walls 115 of the tank, thus keeping a portion of the weight of the core and coils, which often range from between around 150 to 250 lbs., off the bottom of the tank. Also, the I-beam 240 acts as an insulator between the coils and also from the coil to core ground.

Other embodiments are within the scope of the following claims.

For example, the locking features may be any features that lock the I-beam into place, such as levers, self-locking screws, rivets, or spot welding.

The weight of the core and coil assembly may be partially or wholly supported by the shelf. Alternatively or in addition, the tank bottom may partially or wholly support the core and coil assembly.

What is claimed is:

1. A transformer comprising:

a tank having a side wall;

a core defining a core window;

a pair of coils, each of which surrounds a portion of the core and includes a portion passing through the core window;

a core and coil support member that extends through the core window to support the core and coils, the core and coil support member including:

an upper flange and a lower flange, each flange having a channel formed along an outer surface of the flange that conforms in shape to an inner surface of the core;

a web extending between and connecting the upper and lower flanges; and first and second ends formed from extensions of the web beyond the flanges; and a support bracket that attaches to the side wall of the tank and supports the core and coil support member, the support bracket including three sides that define a channel through which the first end of the core and coil member extends.

2. The transformer of claim 1, wherein the core includes:

a first vertical portion;

a second vertical portion similar in shape and size to the first vertical portion;

a first horizontal portion that extends between an end of the first vertical portion and an end of the second vertical portion; and a second horizontal portion that extends between another end of the first vertical portion and another end of the second vertical portion, wherein the vertical and horizontal portions define the core window.

3. The transformer of claim 1, wherein the core and coil support member comprises a reinforced polymer.

4. The transformer of claim 1, wherein:

the upper flange extends perpendicularly from an upper side of the web; and the lower flange extends perpendicularly from a lower side of the web.

5. The transformer of claim 1, wherein the upper and lower flanges are convex.

6. The transformer of claim 1, wherein an upper horizontal portion of the core rests on the upper flange.

7. The transformer of claim 1, wherein the coils fit between the lower flange and the upper flange.

8. The transformer of claim 1, wherein the channel of the upper flange is separated from the channel of the lower flange by a distance that is less than a distance between the upper and lower flanges.

9. The transformer of claim 1, wherein a width of the channel of each of the upper and lower flanges is substantially equal to a width of the inner surface of the core.

10. The transformer of claim 1, wherein the channel of each of the upper and lower flanges is convex.

11. The transformer of claim 1, wherein the channel of each of the upper and lower flanges serves to lock the core into a stationary position.

12. The transformer of claim 1, wherein the channel of each of the upper and lower flanges serves to center the core onto the core and coil support member.

13. The transformer of claim 1, wherein the web separates and insulates the coils from each other.

14. The transformer of claim 1, wherein the web includes:

a first vertical face that extends from the first end such that the first vertical face is perpendicular to the web; and a second vertical face that extends from the second end such that the second vertical face is perpendicular to the web.

15. The transformer of claim 14, wherein the vertical faces increase strength of the core and coil support member.

16. The transformer of claim 1, wherein the tank includes dielectric fluid.

17. The transformer of claim 16, wherein the web includes a thermal duct design along a side of the web that faces the supported coil, the thermal duct design including grooves that provide a flow path for the dielectric fluid between the supported coil and the web.

18. The transformer of claim 1, wherein the upper and lower flanges comprise a snap-fit connector that permits assembly of brackets for components to the core and coil support member.

19. The transformer of claim 1, wherein the core and coil support member comprises an insulating material.

20. A transformer comprising:

a tank having a side wall;

a core defining a core window;

a pair of coils, each of which surrounds a portion of the core and includes a portion passing through the core window;

a core and coil support member that extends through the core window to support the core and coils; and a first support bracket that attaches to the side wall of the tank, and supports the core and coil support member, the first support bracket including:

two parallel side panels;

a rear panel that connects the parallel side panels to define a channel in a first direction through which the core and coil support member is inserted and positioned;

a shelf formed from a lower end of a side panel, the shelf being substantially perpendicular to the first direction; and a locking feature formed from in a side panel, the locking feature providing a retaining force to the core and coil support member in the first direction.

21. The transformer of claim 20, wherein the first support bracket includes a shelf slot that is formed into a lower end of the side panel across the channel from the side panel that forms the shelf, the shelf slot being large enough to accommodate and support the perpendicular shelf.

22. The transformer of claim 20, wherein the locking feature includes side apertures through which self-tapping screws are inserted to secure the core and coil support member within the channel of the first support bracket.

23. The transformer of claim 20, wherein the locking feature includes a tab that is bent inwardly after the core and coil support member is inserted into the channel to secure the core and coil support member within the channel of the first support bracket.

24. The transformer of claim 20, wherein the shelf supports at least a portion of the weight of the core and coil support member when inserted into the channel.

25. The transformer of claim 20, wherein the core and coil support member includes a first end and a second end that extends from the first end in a direction perpendicular to the first direction.

26. The transformer of claim 25, wherein the rear panel includes a spring lever that applies a force to the core and coil support member in the perpendicular direction.

27. The transformer of claim 26, further comprising a second support bracket identical in size and shape to the first support bracket, and attached to an opposite side wall of the tank.

28. The transformer of claim 27, wherein:

the first end of the core and coil support member is inserted and positioned in the channel of the first support bracket; and the second end of the core and coil support member is inserted and positioned in the channel of the second support bracket.

29. The transformer of claim 28, wherein the spring levers of the support brackets automatically center the core and coil support member in the perpendicular direction.

30. The transformer of claim 20, wherein the first support bracket includes a projection bent from a top portion of a parallel side panel in a direction away from the channel.

31. The transformer of claim 30, wherein the angle is based on a size of the coils relative to a size of the tank.

32. The transformer of claim 30, wherein the angle is based on a length of the top portion of the parallel side panel.

33. The transformer of claim 30, wherein the projection facilitates guidance of the core and coil support member through the channel.

34. The transformer of claim 30, wherein one or more components are secured to the projection.

35. The transformer of claim 34, wherein the angle is based on the components secured to the projection.

* * * * *